US008887739B2

(12) United States Patent
Joo et al.

(10) Patent No.: US 8,887,739 B2
(45) Date of Patent: Nov. 18, 2014

(54) HAIR IRON

(75) Inventors: Jong Hyun Joo, Seoul (KR); Min Gi Chae, Mokpo-si (KR)

(73) Assignee: Jong Hyun Joo, Seoul (KR)

( * ) Notice: Subject to any disclaimer, the term of this patent is extended or adjusted under 35 U.S.C. 154(b) by 0 days.

(21) Appl. No.: 14/000,051

(22) PCT Filed: May 3, 2012

(86) PCT No.: PCT/KR2012/003453

§ 371 (c)(1),
(2), (4) Date: Aug. 16, 2013

(87) PCT Pub. No.: WO2012/157865

PCT Pub. Date: Nov. 22, 2012

(65) Prior Publication Data

US 2013/0319452 A1 Dec. 5, 2013

(30) Foreign Application Priority Data

May 17, 2011 (KR) ..... 20-2011-0004204

(51) Int. Cl.

| | |
|---|---|
| ***A45D 1/06*** | (2006.01) |
| ***A45D 2/00*** | (2006.01) |
| ***A45D 1/04*** | (2006.01) |

(52) U.S. Cl.

CPC *A45D 2/001* (2013.01); *A45D 1/06* (2013.01); *A45D 1/04* (2013.01)

USPC ..... 132/224; 132/269

(58) Field of Classification Search

USPC ..... 132/224, 269, 271

See application file for complete search history.

(56) References Cited

U.S. PATENT DOCUMENTS

| | | | | |
|---|---|---|---|---|
| 3,426,766 | A * | 2/1969 | Castellano | 132/239 |
| 7,445,012 | B2 * | 11/2008 | Mukai | 132/224 |
| 7,931,031 | B2 * | 4/2011 | LeGrain | 132/269 |
| 8,071,915 | B2 * | 12/2011 | Mukai | 219/225 |
| 8,418,699 | B2 * | 4/2013 | Kim | 132/224 |
| 2001/0022184 | A1 * | 9/2001 | Lee | 132/225 |

(Continued)

FOREIGN PATENT DOCUMENTS

| | | | |
|---|---|---|---|
| DE | 202009005270 U1 * | 3/2011 | A45D 1/04 |
| JP | 2003-250626 | 9/2003 | |

(Continued)

OTHER PUBLICATIONS

International Search Report for international application No. PCT/KR2012/003453, dated Nov. 21, 2012 (4 pages).

*Primary Examiner* — Robyn Doan
*Assistant Examiner* — Tatiana Nobrega
(74) *Attorney, Agent, or Firm* — Hamre, Schumann, Mueller & Larson, P.C.

(57) ABSTRACT

The present invention relates to a hair iron including: one pair of bodies rotatably hinged to each other; heat plates disposed on the bodies; and supporting means, each being disposed between one of the bodies and one of the heat plates in such a manner as to support the longitudinal center of each heat plate. Accordingly, each supporting means is disposed between each body and each heat plate to support the longitudinal center of each heat plate, so that the pair of heat plates is evenly contacted with each other according to the seesaw principle, thereby allowing the heat and pressure generated from the heat plate to be applied uniformly to hair.

8 Claims, 5 Drawing Sheets

(56) References Cited

U.S. PATENT DOCUMENTS

| | | | | |
|---|---|---|---|---|
| 2006/0207625 | A1* | 9/2006 | Chan | 132/224 |
| 2010/0206322 | A1* | 8/2010 | Mukai | 132/269 |
| 2011/0226278 | A1* | 9/2011 | Rivola | 132/232 |
| 2012/0024311 | A1* | 2/2012 | Linglin et al. | 132/232 |

FOREIGN PATENT DOCUMENTS

| | | | | |
|---|---|---|---|---|
| JP | 2003-339422 | | 12/2003 | |
| KR | 20-0426242 | | 9/2006 | |
| KR | 20-2008-0000386 | | 4/2008 | |
| WO | WO 2009/050799 | * | 4/2009 | A45D 1/04 |

* cited by examiner

HAIR IRON

TECHNICAL FIELD

The present invention relates to a hair iron, and more particularly, to a hair iron that allows upper and lower heat plates to be evenly contacted with each other through seesaw functions, so that the heat and pressure generated from the upper and lower heat plates are applied uniformly to hair.

BACKGROUND ART

Generally, hair cosmetic tools include scissors for hair cutting, hair blades, hair driers, heating caps, hair clips, hair irons and the like, which have various shapes and functions in accordance with their use purposes.

Among them, the hair irons, which are tools for changing the structure of hair using heat, are divided into curling irons for forming temporary curls on hair, straightening irons for straightening hair, and crimping irons for forming crimps on hair.

An example of the conventional hair irons is shown in FIG. 1. FIG. 1 is a side sectional view showing the hair iron in the conventional practice.

As shown in FIG. 1, the hair iron in the conventional practice includes an upper body 1 and a lower body 3 hinge-coupled to each other on one sides thereof in such a manner as to be open and closed on the other sides thereof. An upper heat plate 5 is mounted on one surface of the upper body 1. Further, a lower heat plate 7 facing the upper heat plate 5 is mounted on one surface of the lower body 3. According to the conventional hair iron, hair is located between the upper heat plate 5 and the lower heat plate 7, and a given pressure is applied to the upper body 1 and the lower body 3, so that the upper heat plate 5 and the lower heat plate 7 come into contact with each other, thereby allowing the hair to be ironed through the heat generated therefrom.

According to the conventional hair iron, however, since the upper body 1 and the lower body 3 are made of synthetic resin, they are deformed (expanded or contracted) by means of the heat generated from the upper heat plate 5 and the lower heat plate 7, and at this time, the facing surfaces of the upper heat plate 5 and the lower heat plate 7 mounted on the upper body 1 and the lower body 3 do not come into contact with each other horizontally.

Accordingly, the facing surfaces of the upper heat plate 5 and the lower heat plate 7 are not completely contacted with each other horizontally, and the upper heat plate 5 and the lower heat plate 7 are partially contacted with each other.

That is, the upper heat plate 5 and the lower heat plate 7 are contacted partially with the hair, so that the heat and pressure generated from the upper heat plate 5 and the lower heat plate 7 are not uniformly applied to the hair. Of course, the hair located between the upper heat plate 5 and the lower heat plate 7 cannot be changed in structure uniformly.

According to the conventional hair iron, furthermore, the hair ironing results are different in accordance with an operator's ironing pressures, so that they are determined upon the operator's experiences (skill levels), thereby failing to obtain the reliability from customers.

DISCLOSURE

Technical Problem

Accordingly, the present invention has been made in view of the above-mentioned problems occurring in the prior art, and it is an object of the present invention to provide a hair iron that allows upper and lower heat plates to be evenly contacted with each other through seesaw functions, so that the heat and pressure generated from the upper and lower heat plates are applied uniformly to hair.

It is another object of the present invention to provide a hair iron that greatly prevents the inclined portions of upper and lower heat plates toward one sides thereof from first facing each other.

It is yet another object of the present invention to provide a hair iron that allows the upper and lower heat plates to be adjusted in pressure.

Technical Solution

To accomplish the above objects, according to the present invention, there is provided a hair iron including: one pair of bodies rotatably hinged to each other; heat plates disposed on the bodies; and supporting means, each being disposed between one of the bodies and one of the heat plates in such a manner as to support the longitudinal center of each heat plate.

According to the present invention, preferably, each supporting means includes an elastic member disposed between each body and each heat plate.

According to the present invention, preferably, each supporting means includes a compression spring disposed between each body and each heat plate.

According to the present invention, preferably, each heat plate includes: an accommodating portion into which a horizontal support rod is inserted longitudinally; and an open portion formed at a bottom part of accommodating portion. The horizontal support rod has a suspended portion suspended in the both sides of the open portion.

According to the present invention, preferably, the horizontal support rod has pressure exceeding prevention barriers mounted on both sides thereof, the pressure exceeding prevention barriers having the same heights as the top surface of each heat plate.

According to the present invention, preferably, each body has locking protrusions formed on both sides thereof so as to support the heat plate or the horizontal support rod and to prevent them from being escaped therefrom.

According to the present invention, preferably, the hair iron further includes a cover disposed between each heat plate and each body to cover the heat plate and buffering members interposed between the cover and the heat plate, the supporting means being disposed between the cover and the body.

According to the present invention, preferably, the supporting means is formed of a semi-circular protruding portion protruded from the cover toward the body.

According to the present invention, preferably, the supporting means is formed of a semi-circular protruding portion protruded from the body toward the cover.

According to the present invention, preferably, the cover has pressure exceeding prevention barriers mounted on both sides thereof, the pressure exceeding prevention barriers having the same heights as the top surface of each heat plate.

According to the present invention, preferably, each body has an elongated hole formed thereon, and each heat plate has an insertion part formed thereon in such a manner as to be inserted into the elongated hole.

According to the present invention, preferably, each body includes: an adjustor having a lead screw mounted thereon; a pair of nuts fitted on the lead screw in such a manner as to be moved in the direction approaching each other or in the direction distant from each other in accordance with the forward or reverse rotation of the adjustor; and the supporting means is formed of a plate spring disposed between the pair of nuts.

Advantageous Effects

According to the present invention, the hair iron has the elastic member disposed between each body and each heat plate to support the longitudinal center of each heat plate, so that the pair of heat plates is evenly contacted with each other according to the seesaw principle, thereby allowing the heat and pressure generated from the heat plate to be applied uniformly to hair.

Further, uniform results can be obtained irrespective of the existence and non-existence of an operator's experiences.

Moreover, uniform pressures generated from the heat plates are always applied regularly to hair, thereby reducing the stress applied to the hair.

On the other hand, the formation of the pressure exceeding prevention barriers prevents the hair from first facing the portions inclined toward one sides of the heat plates.

Furthermore, each heat plate is moved in such a manner that each heat plate compress the elastic member ahead of the pressure exceeding prevention barriers because of the hair's thickness. Contrarily, since the pressure exceeding prevention barriers are configured to be pressed after the pressing force has been applied to the heat plate, they serve to allow the pressure applied to the hair during the hair ironing to stay within the range of elastic force of the elastic member.

Also, the pressures of the heat plates can be adjusted through the adjustor.

BEST MODE FOR INVENTION

Hereinafter, an explanation on a hair iron according to preferred embodiments of the present invention will be in detail given with reference to the attached drawings.

Figure 1:
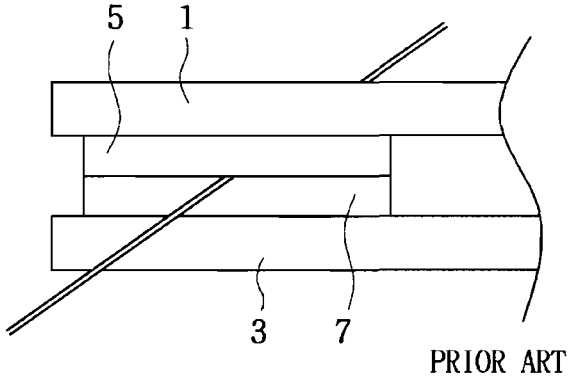
FIG. 1 is a side sectional view showing a hair iron in the conventional practice.
Figure 2:
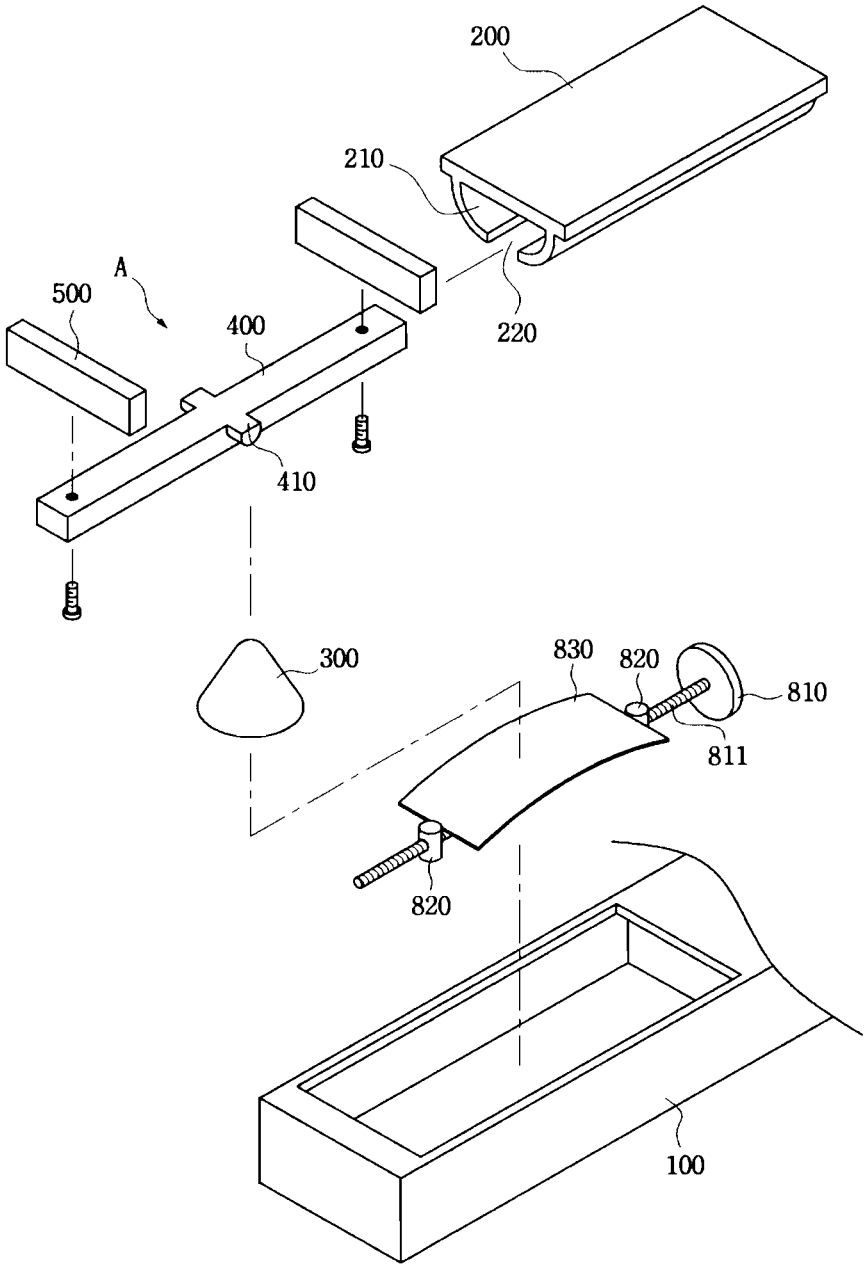
FIG. 2 is an exploded perspective view showing a hair iron according to a preferred embodiment of the present invention.
Figure 3:
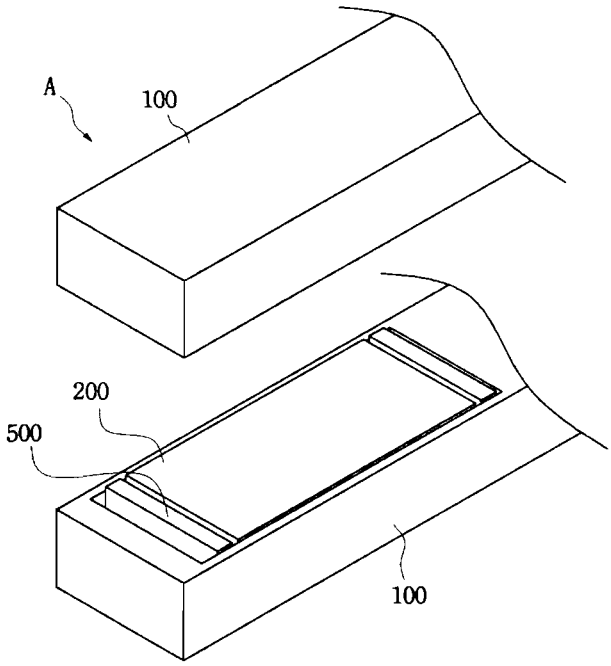
FIG. 3 is a perspective view showing the assembled state of FIG. 2.
Figure 4:
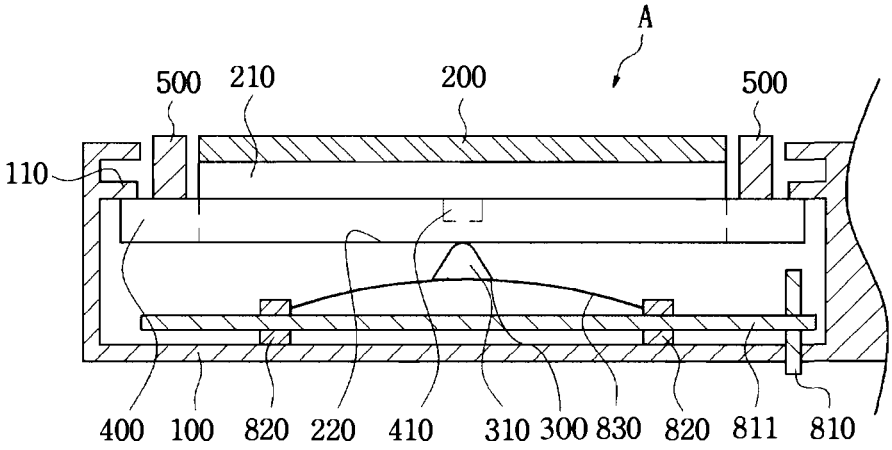
FIG. 4 is a sectional view showing a portion a-a in FIG. 3.

FIG. 2 is an exploded perspective view showing a hair iron according to a preferred embodiment of the present invention, FIG. 3 is a perspective view showing the assembled state of FIG. 2, FIG. 4 is a sectional view showing a portion a-a in FIG. 3, and FIGS. 5*a* to 9 are sectional views showing a hair iron according to other preferred embodiments of the present invention.

As shown in FIGS. 2 to 9, a hair iron A according to the present invention includes one pair of bodies 100 rotatably hinged to each other, heat plates 200 disposed on the bodies 100, and supporting means 300, each being disposed between one of the bodies 100 and one of the heat plates 200 in such a manner as to support the longitudinal center of each heat plate 200.

Figure 5A:
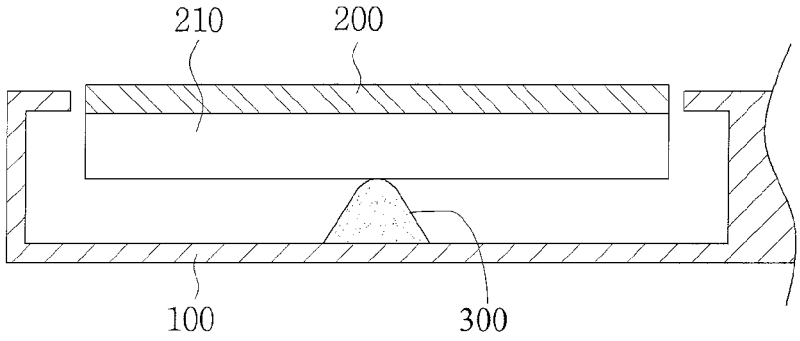
FIGS. 5*a* to 9 are sectional views showing a hair iron according to other preferred embodiments of the present invention.

As shown in FIGS. 4 and 5*a*, further, each supporting means 300 may be an elastic member disposed between each body 100 and each heat plate 200, and the elastic member is desirably formed of a resilient material such as silicone, rubber and the like.

At this time, the elastic member has a section of a conical shape.

Figure 5B:
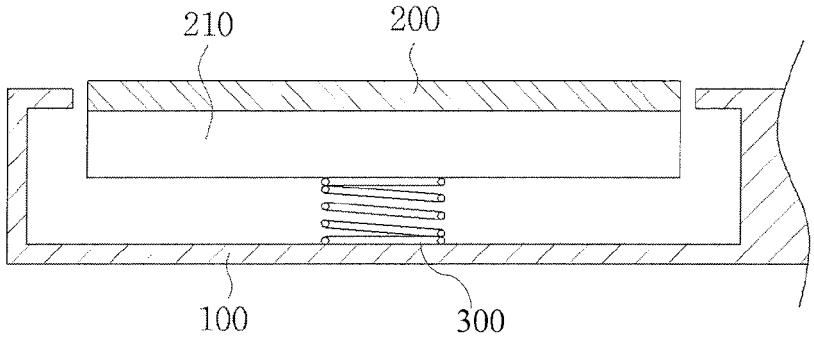

As shown in FIG. 5*b*, further, each supporting means 300 may be a compression spring disposed between each body 100 and each heat plate 200.

On the other hand, each heat plate 200 has an accommodating portion 210 into which a horizontal support rod 400 is inserted longitudinally, and an open portion 220 having a reduced width than the accommodating portion 210. The horizontal supporting rod 400 has a suspended portion 410 suspended on the both sides of the open portion 220. The underside of the suspended portion 410 is desirable rounded.

Pressure exceeding prevention barriers 500 are mounted on both sides of the horizontal support rod 400, while having the same heights as the top surface of each heat plate 200.

Further, the underside surface of each heat plate 200 and the underside surface of the horizontal support rod 400 desirably have the same heights as each other so as to face the supporting means 300.

Besides, each body 100 has locking protrusions 110 so as to support the heat plate 200 or the horizontal support rod 400 and to prevent them from being escaped therefrom.

Accordingly, each supporting means 300, which supports the longitudinal center of each heat plate 200, is disposed between each body 100 and each heat plate 200, so that one pair of heat plates 200 is evenly contacted with each other, thereby enabling the heat and pressure generated from the heat plates 200 to be regularly applied to hair.

That is, even if the bodies 100 are deformed by means of the heat generated from the heat plates 200, the facing portions of the heat plates 200 are always brought into contact with each other horizontally to allow the heat and pressure generated from the heat plates 200 to be applied to hair, thereby obtaining uniform ironing results.

Further, uniform ironing results can be obtained irrespective of the existence and non-existence of an operator's experiences.

Moreover, the heat plates 200 always apply uniform pressures to the hair, thereby reducing the stress applied to the hair.

On the other hand, if the heat plates 200 are inclined to one side, they first come into contact with the pressure exceeding prevention barriers 500 mounted on the horizontal support rod 400, thereby greatly preventing the hair from first contacting the inclined portions of the heat plates 200.

Furthermore, each heat plate 200 is moved in such a manner that each heat plate 200 compress the elastic member ahead of the pressure exceeding prevention barriers 500 because of the hair's thickness.

Contrarily, since the pressure exceeding prevention barriers 500 are configured to be pressed after the pressing force has been applied to the heat plate 200, they serve to allow the pressure applied to the hair during the hair ironing to stay within the range of elastic force of the elastic member.

For example, in the state where hair to be ironed is located between one pair of heat plates 200 by an operator of the hair iron A according to the present invention, if an exceeding pressure is applied to the bodies 100, the hair located between the heat plates 200 may be changed from the round shape before the ironing to the oval shape after the ironing. In this case, the pressure exceeding prevention barriers 500 come into contact with each other before the exceeding pressure is applied from the heat plates 200 to the hair, thereby preventing the hair from being changed into an oval shape.

On the other hand, pressure adjusting means is provided to adjust the pressure of the supporting means 300. In more detail, the pressure adjusting means includes an adjustor 810 having a lead screw 811 mounted on each body 100, a pair of nuts 820 fitted on the lead screw 811 in such a manner as to be moved in the direction approaching each other or in the direction distant from each other in accordance with the forward or reverse rotation of the adjustor 810, and a plate spring 830 disposed between the pair of nuts 820 to support the supporting means 300 thereagainst.

Accordingly, the pressures of the heat plates 200 can be adjusted in accordance with the forward or reverse rotation of the adjustor 810.

Figure 6:
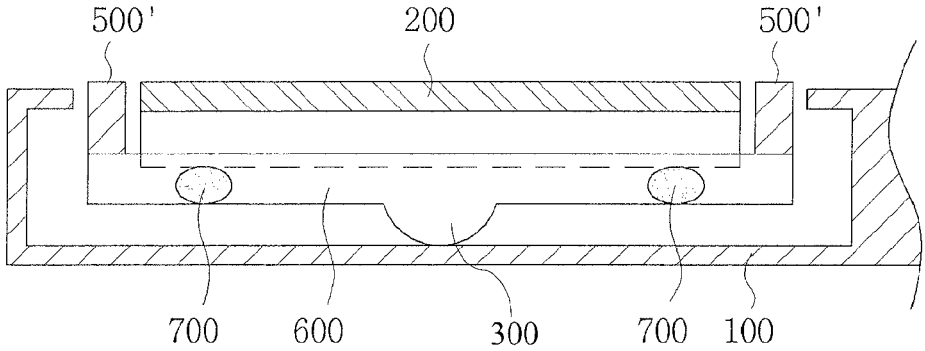
Figure 7:
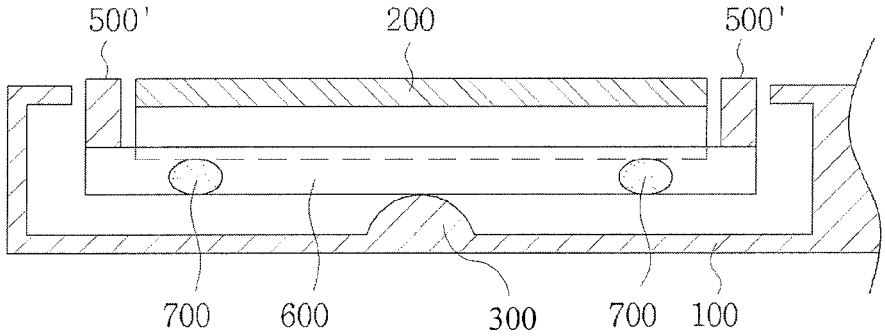

FIGS. 6 and 7 show other preferred embodiments of the present invention, wherein a cover 600 is further provided between each heat plate 200 and each body 100 to cover the heat plate 200, buffering members 700 are interposed between the cover 600 and the heat plate 200, and the supporting means 300 is disposed between the cover 600 and the body 100.

Further, as shown in FIG. 6, the supporting means 300 may be formed of a semi-circular protruding portion protruded from the cover 600 toward the body 100, and as shown in FIG. 7, the supporting means 300 may be formed of a semi-circular protruding portion protruded from the body 100 toward the cover 600.

On the other hand, pressure exceeding prevention barriers 500' are mounted on both sides of the cover 600, while having the same heights as the top surface of each heat plate 200.

Figure 8:
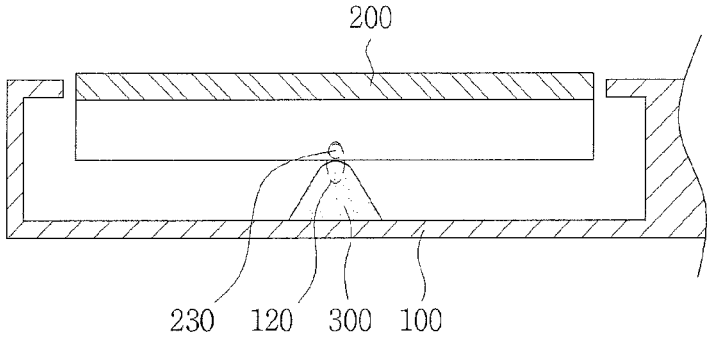

FIG. 8 shows another preferred embodiment of the present invention, wherein each body 100 has an elongated hole 120 formed thereon, and each heat plate 200 has an insertion part 230 formed thereon in such a manner as to be inserted into the elongated hole 120.

Figure 9:
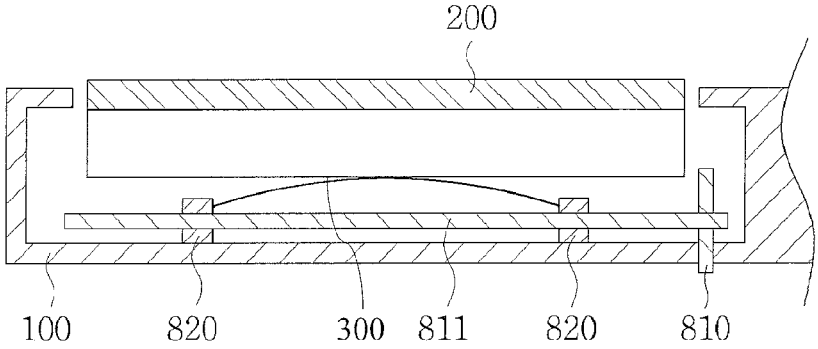

FIG. 9 shows yet another preferred embodiment of the present invention, wherein an adjustor 810 having a lead screw 811 is mounted into each body 100, a pair of nuts 820 is fitted on the lead screw 811 in such a manner as to be moved in the direction approaching each other or in the direction distant from each other in accordance with the forward or reverse rotation of the adjustor 810, and the supporting means 300 may be formed of a plate spring disposed between the pair of nuts 820.

Accordingly, the elastic force of the plate spring can be adjusted in accordance with the forward or reverse rotation of the adjustor 810.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

For example, the supporting means is disposed on both of the pair of heat plates, but of course, it may be disposed on any one of the pair of heat plates.

The invention claimed is:

1. A hair iron comprising:

one pair of bodies rotatably hinged to each other;

a heat plate disposed on one of the bodies;

a supporting member, the supporting member being disposed between the one of the bodies and the heat plate in such a manner as to support a longitudinal center of the heat plate; and a horizontal support rod;

wherein the heat plate comprises:

an accommodating portion into which the horizontal support rod is inserted longitudinally; and an open portion formed at a bottom part of the accommodating portion; and wherein the horizontal support rod has a suspended portion suspended on both sides of the open portion;

the heat plate and the horizontal support rod are supported by the supporting member at the same time;

the horizontal support rod has a first end and a second end; a pressure exceeding prevention barrier is mounted on each of the first and second ends, the pressure exceeding prevention barriers have a height that is the same as a top surface of the heat plate; and, the one of the bodies has a locking protrusion to support the horizontal support rod and to prevent the horizontal support rod from being escaped from the one of the bodies;

wherein each body comprises: a lead screw rotatably mounted thereon; an adjuster fixed on the lead screw and the adjuster protruding from the body; a pair of nuts connected around the lead screw, the pair of nuts separated by a distance from each other; and a plate spring disposed and bulging upwardly between the pair of nuts to support the bottom of the supporting member; wherein the pair of nuts move in a direction approaching each other or in a direction departing from each other in accordance with the forward or reverse rotation of the adjustor so as to deform the plate spring.

2. The hair iron according to claim 1, wherein the supporting member comprises an elastic member disposed between the one of the bodies and the heat plate.

3. The hair iron according to claim 1, wherein the supporting member comprises a compression spring disposed between the one of the bodies and the heat plate.

4. The hair iron according to claim 1, wherein the open portion has a reduced width than the bottom part of accommodating portion.

5. The hair iron according to claim 1, wherein each body has an elongated hole formed thereon, and each heat plate has an insertion part formed thereon in such a manner as to be inserted into the elongated hole.

6. A hair iron comprising:

a pair of bodies rotatably hinged to each other;

a heat plate disposed on one of the bodies;

a cover disposed between the heat plate and the one of the bodies to cover the heat plate;

buffering members interposed between the cover and the heat plate, the buffering members supporting the heat plate;

a supporting member being disposed at a longitudinal center of the cover, the supporting member including a protrusion protruding from the one of the bodies toward the cover or from the cover toward the one of the bodies; and pressure exceeding prevention barriers provided on both ends of the cover, wherein a height of the prevention barriers are the same as a height of a top surface of the heat plate;

wherein each body comprises: a lead screw rotatably mounted thereon; an adjuster fixed on the lead screw and protruding from the body; a pair of nuts connected around the lead screw, the pair of nuts separated by a distance from each other and fitted on the lead screw in such a manner as to be moved in a direction approaching each other or in a direction departing from each other in accordance with the forward or reverse rotation of the adjustor; a plate spring disposed between the pair of nuts, and bulging upwardly to support the support the bottom of the supporting member; wherein the pair of nuts move in a direction approaching each other or in a direction departing from each other in accordance with a forward or reverse rotation of the adjustor to deform the plate spring.

7. The hair iron according to claim 6, wherein the supporting member is formed of a semi-circular protruding portion protruded from the body toward the cover.

8. The hair iron according to claim 6, wherein each body has an elongated hole formed thereon, and each heat plate has an insertion part formed thereon in such a manner as to be inserted into the elongated hole.

* * * * *